US005218939A

United States Patent [19]

Stumpp

[11] Patent Number: 5,218,939

[45] Date of Patent: Jun. 15, 1993

[54] ARRANGEMENT FOR CONTROLLING THE IDLE SPEED OF AN ENGINE OF A MOTOR VEHICLE

[75] Inventor: Gerhard Stumpp, Stuttgart, Fed. Rep. of Germany

[73] Assignee: Robert Bosch GmbH, Stuttgart, Fed. Rep. of Germany

[21] Appl. No.: 837,926

[22] Filed: Feb. 20, 1992

[30] Foreign Application Priority Data

Feb. 20, 1991 [DE] Fed. Rep. of Germany ..... 4105161

[51] Int. Cl.[5] ..... F02D 31/00; F02D 41/14; F02D 43/00

[52] U.S. Cl. ..... 123/339

[58] Field of Search ..... 123/339, 350, 352; 180/178, 179; 364/431.05, 431.07

[56] References Cited

U.S. PATENT DOCUMENTS

| | | | |
|---|---|---|---|
| 4,441,471 | 4/1984 | Kratt et al. | 123/339 |
| 4,819,596 | 4/1989 | Yasuoka et al. | 123/339 |
| 4,877,002 | 10/1989 | Shimomura et al. | 123/339 |
| 4,951,627 | 8/1990 | Watanabe et al. | 123/339 |
| 4,955,341 | 9/1990 | Trombley et al. | 123/339 |
| 4,966,111 | 10/1990 | Fujimoto et al. | 123/339 |
| 4,976,238 | 12/1990 | Toyoda | 123/339 |
| 5,043,647 | 8/1991 | Flaig et al. | 318/610 |
| 5,069,181 | 12/1991 | Togai et al. | 123/339 |

*Primary Examiner*—Willis R. Wolfe
*Attorney, Agent, or Firm*—Walter Ottesen

[57] ABSTRACT

The invention is directed to an arrangement for controlling the engine speed and especially the idle engine speed of an engine of a motor vehicle. The pregiven idle engine speed desired value is controlled in dependence upon the road speed of the motor vehicle so that this desired value becomes greater with increasing road speed.

9 Claims, 2 Drawing Sheets

ARRANGEMENT FOR CONTROLLING THE IDLE SPEED OF AN ENGINE OF A MOTOR VEHICLE

FIELD OF THE INVENTION

The invention relates to an arrangement for controlling the idle speed of an engine of a motor vehicle in dependence upon a pregiven value and a measured value.

BACKGROUND OF THE INVENTION

An arrangement of the kind described above is disclosed in U.S. Pat. No. 4,441,471. The arrangement for controlling the idle engine speed disclosed in this patent includes a desired-value forming unit which forms an engine speed desired value in dependence upon various operating variables of the engine and of the motor vehicle. This desired value is compared to the actual measured engine speed value in a comparator unit. A controller forms an output signal in dependence upon the difference between the desired and actual values of the engine speed. The output signal is provided for adjusting the actuator element influencing the speed of the engine in the sense of reducing the difference between the desired and actual engine speeds. A transmission control signal is applied for forming the desired value in order to avoid jumps in the engine speed when a switchover is made from the neutral position to the drive position in an automatic transmission.

The engine speed fluctuates as a consequence of the compression and combustion during operation of the engine. The amplitude of these fluctuations increases with decreasing engine speed. These engine speed fluctuations can excite the vehicle drive and/or the vehicle itself into oscillations especially when the exciting frequency lies close to a resonant frequency of the engine drive and/or of the vehicle itself. Experience has shown that such oscillations (bucking) take place especially at low engine speeds in the range of idle engine speed in the presence of a force connection between engine and transmission which oscillations operate to reduce the driving comfort in this operating condition. This becomes especially manifest when driving in a column or in heavy traffic when the motor vehicle is moving forward at lower engine speed in the range of idle engine speed and in the presence of a force connection, that is, for example in the case of a manual gear shift with a gear in place and the clutch engaged.

SUMMARY OF THE INVENTION

In view of the above, it is an object of the invention to provide an arrangement wherein the operational comfort of the motor vehicle is improved and wherein the bucking in the range of engine idle speed is effectively prevented. This is achieved in that an arrangement for controlling the idle engine speed of an engine is configured in such a manner that the desired value thereof is influenced in dependence upon the road speed of the motor vehicle. The desired value becomes greater in magnitude with increasing road speed with the connection between desired value and road speed being selected such that the oscillation-sensitive range of lower engine speed is avoided.

It is a further object of the invention to provide comfortable driving of a motor vehicle when the transmission is engaged at engine speeds in the range of idle engine speed. This is achieved by limiting the road speed to a minimum value.

Arrangements for avoiding bucking in internal combustion engines are known of which the arrangement disclosed in international patent publication WO-A 89/07709 is exemplary. To avoid bucking, a signal is formed on the basis of the engine speed signal and on the basis of a transmission position signal from a characteristic field. This signal changes as a function of time and these changes are logically connected to the signal of the fuel quantity to be metered with this fuel quantity signal being derived from the engine speed and the accelerator pedal position. This logic connection takes place in such a manner that a control is provided against changes of the quantity of fuel to be metered.

U.S. Pat. No. 5,043,647 discloses an engine speed controller having a desired engine speed value formed from the output signal of a road speed controller. This output signal is a function of the difference between a desired speed signal and an actual speed signal of the vehicle. Such an arrangement makes possible a rapid and precise control of the road speed and improves the stability of the road speed control loop. However, avoidance of bucking in the engine speed range near idle is not provided.

The arrangement of the invention improves the operational comfort of the motor vehicle and effectively avoids the occurrence of bucking in a simple manner in the engine speed range near idle.

The oscillation-sensitive range of low engine speeds and bucking in the region of idle engine speed is avoided with the speed-dependent input of the desired idle engine speed.

With an engaged transmission train, the measures of the invention provide a minimum limit of the road speed of the vehicle in an advantageous manner. In this way, a quiet forward movement of the vehicle at pregiven minimum speed is possible during travel in a column with an engaged transmission train without oscillations occurring in the drive train.

The procedure of the invention provides special advantages when the speed-dependent open-loop control of the desired value takes place only during an engaged transmission train. For a standing motor vehicle with an open drive train or during a switching operation (that is, in the absence of an engaged transmission train), a low idle engine speed can be pregiven which is characterized by reduced noise and a savings of fuel.

These measures therefore permit an adaptation of the idle engine speed to the particular operating condition with the occurring resonant frequencies of the motor vehicle being prevented from becoming effective during a drive with an engaged transmission train in the range of idle engine speed. For a standing motor vehicle, a low engine speed is pregiven so that the idle engine speed control for a standing vehicle is not negatively influenced by the measures provided by the invention.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
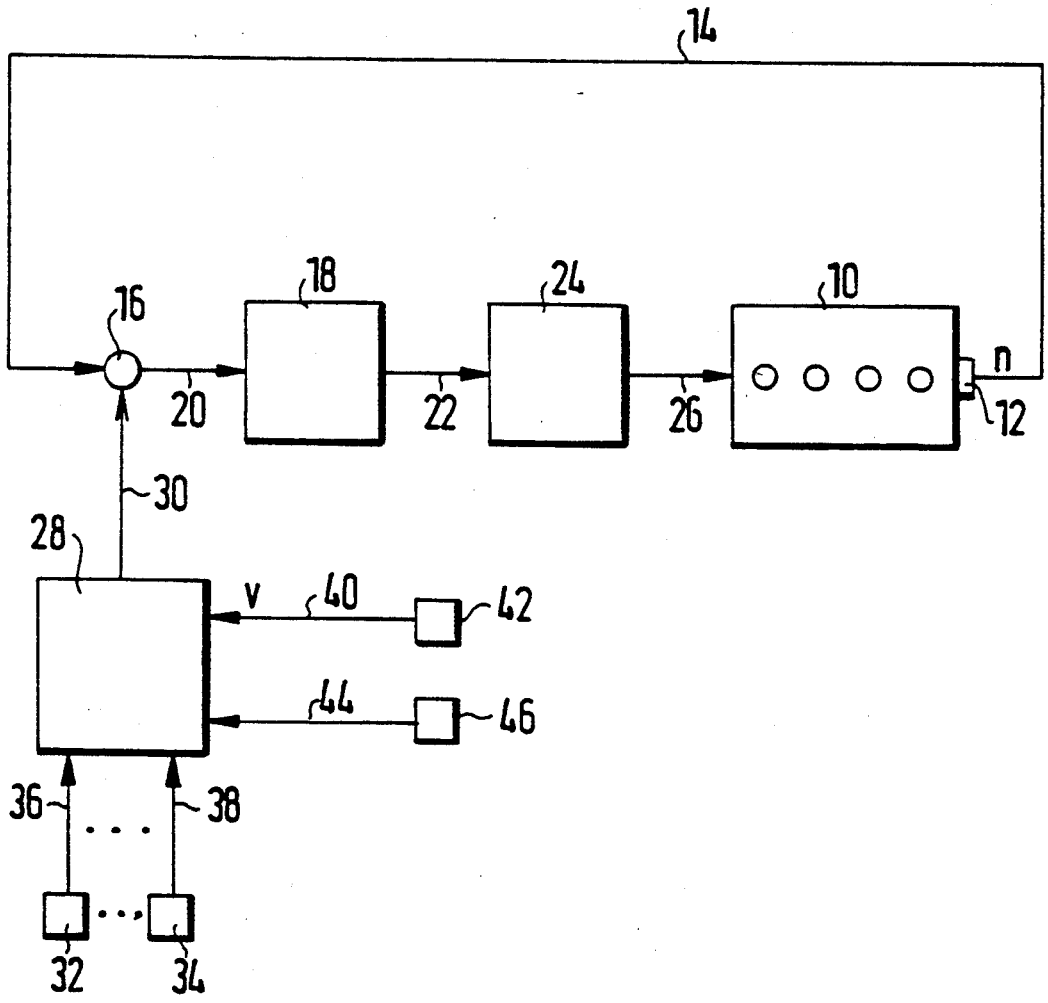
FIG. 1 shows a block diagram of an idle engine speed control wherein the measures provided by the invention are realized.

FIG. 1 shows an internal combustion 10 which is provided with at least one engine speed sensor 12 having an output line 14 connected to a comparator unit 16. In addition to the comparator unit 16, the idle speed control system includes a controller 18 which is connected to comparator unit 16 via its input line 20. The output line 22 of the controller 18 is connected to an actuator 24 which controls an element influencing the speed of the engine. The actuator 24 controls the element via a connection 26 to the engine 10. This element can, for example, be a throttle flap controlling the air input to the engine or an injection pump controlling the fuel metered to the engine.

The idle speed control system further includes a desired-value forming unit 28 having an output line 30 connected to the comparator unit 16. The output line 30 carries the desired value formed from operating variables of the engine or of the motor vehicle. Input variables of the desired value forming unit 28 are supplied from measuring units 32 to 34 (not shown) via the corresponding input lines 36 to 38, respectively. The operating variables detected by the measuring units 32 to 34 together with engine speed control are familiar to persons working in this area. For example, these variables can include engine temperature, battery voltage, transmission position, actual engine speed, position of the actuator 24 with a position control of the actuator and/or for determining the idle condition and the like. The measuring unit is identical with the engine speed sensor 12 in the case of the actual engine speed.

The road speed of the vehicle is supplied to the desired value forming unit 28 via the input line 40 from a road speed sensor 42. In an advantageous embodiment, the speed-dependent open-loop control of the desired value takes place in dependence upon the presence of a force connection. For this purpose, a further input line 44 is connected to the desired-value forming unit 28 which connects the same to a detecting unit 46 for the engaged drive train of the motor vehicle. This unit, which is not necessarily present, provides the force closure by means of a transmission position signal and a coupling position signal. The unit 46 can however also be a component of the desired-value forming unit 28 to which a coupling position signal from a corresponding measuring unit 32 to 34 is supplied or which derives the engaged transmission train by means of the quotient of the engine speed signal and road speed signal.

The operation of the idle speed control system of FIG. 1 is known from the state of the art. Operating variables are detected via the measuring units 32 to 34. In dependence upon these operating variables, a desired value is derived by the desired-value forming unit 28 for the idle speed control with this desired value being supplied via the output line 30 to the comparator unit 16. The actual engine speed is supplied to the comparator unit 16 from the engine speed sensor 12 and the desired value is compared to this engine speed in the comparator unit. The comparison defines a difference formation between the desired and actual values with the difference being supplied to the controller 18 from the comparator unit 16 via the line 20. The controller 18 forms an output signal 22 for adjusting the actuator 24 in dependence upon the magnitude of this difference. In this way, the element of the engine influencing the engine speed is adjusted in the sense of reducing this difference. The actuator 24 is then driven in such a manner that the actual speed of the engine changes in the direction of the pregiven desired engine speed. The controller is then configured in correspondence to controllers known from controller technology such as a PI-controller.

The idle control is only active in the detected idle condition. Outside of this operating condition, the actuator is open-loop adjusted or assumes a middle position. The idle condition is derived from the operating variables of the engine or of the vehicle. Criteria are, for example, that the position of the actuator or of the accelerator pedal has dropped below a predetermined value and the engine speed lies below a specific value dependent upon the desired engine speed.

On the basis of the tasks described above, a road speed signal of the motor vehicle is supplied from sensor 42 to the desired-value forming unit via the input line 40 and the desired value of the engine is increased in dependence upon the magnitude of the road speed. The functional interrelationship between motor vehicle speed and the desired engine speed is shown in FIG. 2 and is stored in the desired-value forming unit 28 in the form of a characteristic or in the form of a temperature-dependent characteristic field or as a corresponding table.

Figure 2:
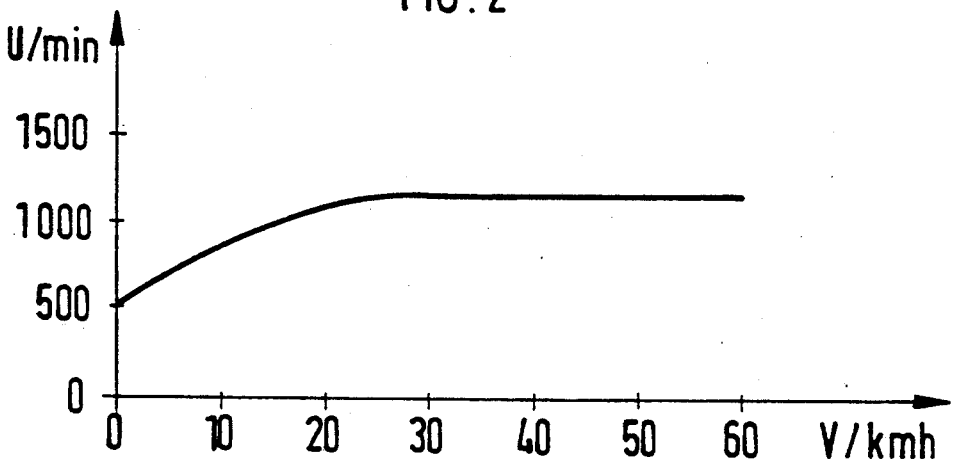
FIG. 2 shows schematically the dependence of the idle engine speed desired value on the road speed of the vehicle; and, FIG. 3 is a flowchart exemplary of a realization of the measures provided by the invention in the form of a computer program.

In FIG. 2, the road speed V of the motor vehicle in kilometers per hour is plotted on the horizontal axis while the desired speed U of the engine in liter per minute is plotted along the vertical axis. The numerical values shown are exemplary and can be different in accordance with the particular engine or type of motor vehicle. Stated otherwise, the engine speed desired values applied to the particular road speed can deviate by a specific amount, which can lie in the range of 50%, from that shown in FIG. 2.

Accordingly, the engine speed desired value is increased starting from a lower amount at zero road speed, which is fixed by the operating variables supplied via the lines 36 to 38, with increasing road speed.

In the region of road speeds in the order of zero and with the transmission train closed, the measure of the invention leads to a minimum limit of the road speed to the road speed value pregiven by the gear position and the engine speed. This is achieved because of the fixed arrangement of engine speed and road speed by means of the particular gear in place. The measure provided by the invention limits the road speed to a minimum speed of the vehicle for an engaged transmission train and while driving in a column. In this way, the vehicle moves forward with a high level of comfort and there is no danger that the engine will stall.

In an advantageous manner, the road-speed dependent open-loop control of the idle speed desired value is only active when the drive train is engaged. For this reason, a signal indicating a closed drive train is supplied to the desired-value forming unit 28 via the input line 44 from the detecting unit 46. The road-speed dependent open-loop control of the desired value is then activated in the desired-value forming unit in dependence upon whether the drive train is closed. If the drive train is open, then the desired value is pregiven independently of the road speed by the operating variables detected by the measuring units 32 to 34.

Figure 3:
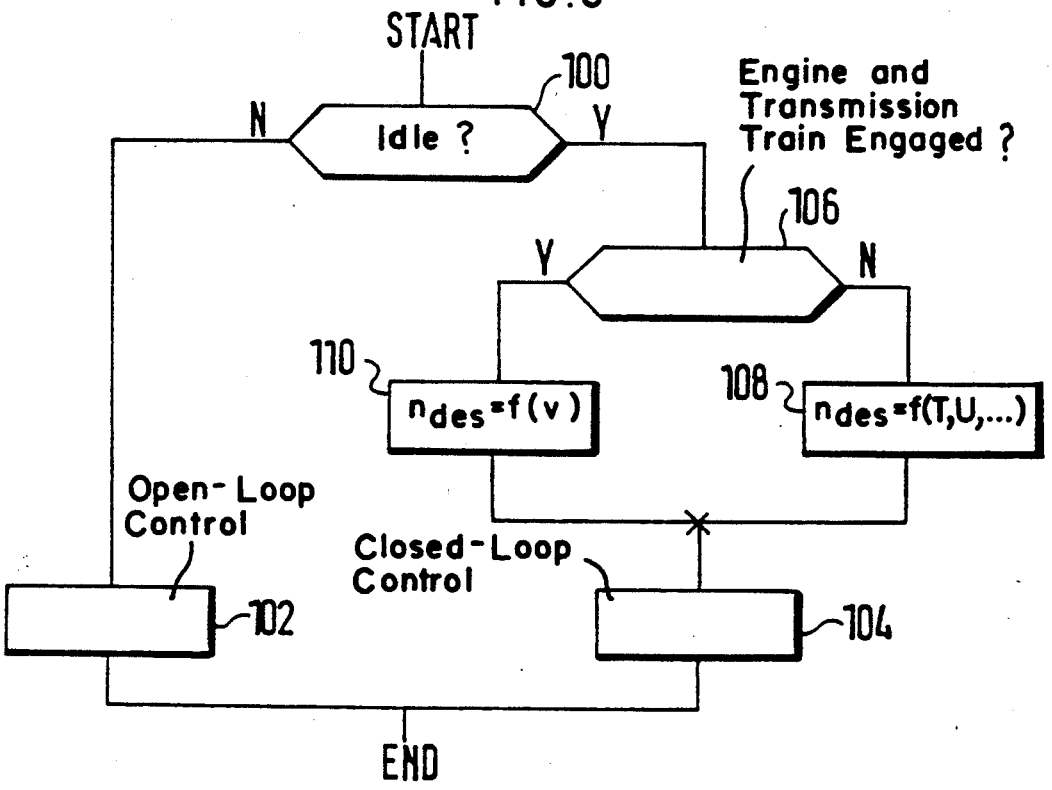

FIG. 3 shows an embodiment of a flowchart for realizing the measures of the invention in the form of a computer program. After the start of the program part, a check is made in a first step 100 as to whether the above-described conditions are fulfilled for activating the idle speed control. This is for example determined by the positions of the actuator 24 via inputs of a road speed limit and an engine speed limit for which there must be a drop below these limits in order to activate the control. If this is not the case, then an open-loop control of the actuator for the idle speed control is active according to step 102. Here, the actuator 24 is opened, for example, in dependence upon engine speed or to a mean pregiven value. If the condition of step 100 is fulfilled, then the idle engine speed is controlled in dependence upon the desired and actual values according to step 104. These measures are known adequately from the state of the art.

Before the control is initiated in accordance with step 104, a check however is made in step 106 as to whether the drive train is closed or open, that is, as to whether a force flow is present or not. This measure can take place with the evaluation of a transmission position signal and/or of a coupling signal without the comparison of the quotient of engine speed and road speed with amounts pregiven by a closed drive train. If the drive train is open, that is if it is assumed that idle operation is indeed present, then the desired value for the closed-loop control of the idle engine speed is formed in accordance with step 108 in dependence upon known operating variables and the control is carried out according to step 104.

However, if a closed drive train is detected in step 106, then the desired value of the idle engine speed control is open-loop controlled in step 110 in dependence upon the road speed as shown in FIG. 2. The control according to step 104 is then carried out in dependence upon the desired value formed in step 110.

The program part is ended after steps 104 and 102 and repeated after a pregiven time duration.

In addition to the formation of the desired value in dependence upon road speed in step 110, an engine temperature-dependent desired value formation (for example by maximum selection) can be superposed in order to prevent the engine from stalling while warm at low road speeds and with an engaged drive train.

In the foregoing, a control of the engine speed with the input of an engine speed desired value has been described. In the context of other advantageous embodiments, the control can take place while inputting other desired values or pregiven values for the following: ignition angle, the charge supplied to the engine, the position of an injection pump for determining the quantity of fuel to be metered to the engine or the position of an element determining the air supplied to the engine. The same applies for the measured value compared to the pregiven value.

It is understood that the foregoing description is that of the preferred embodiments of the invention and that various changes and modifications may be made thereto without departing from the spirit and scope of the invention as defined in the appended claims.

What is claimed is:

1. An arrangement for controlling the idle speed of an engine of a motor vehicle, the arrangement comprising:

an actuator for acting on said engine to influence the speed thereof;

first sensor means for detecting the actual speed of the engine and providing a first signal having an actual value indicative of said actual speed;

second sensor means for detecting the road speed of the motor vehicle;

desired-value forming means connected to said second sensor means for forming a second signal indicative of a desired value of a desired speed for said idle speed dependent upon said road speed;

comparison means for comparing said first and second signals to form a difference signal indicative of the deviation of said desired speed from said actual speed; and, a controller receiving said difference signal for forming and supplying an output signal to said actuator to thereby cause said actual speed to approach said desired speed.

2. The arrangement of claim 1, wherein said desired value becomes greater in amount with increasing road speed.

3. The arrangement of claim 1, wherein said desired value is influenced when the engine and vehicle transmission are mutually engaged.

4. The arrangement of claim 1, wherein said desired value is stored in a memory for every value of road speed in the form of a characteristic or a temperature-dependent characteristic field or as a table.

5. The arrangement of claim 1, wherein the dependency of said desired value on the road speed is so selected that the oscillation-sensitive engine speed range near idle engine speed is not reached.

6. The arrangement of claim 1, wherein said desired value is dependent upon operating variables such as engine temperature, battery voltage and the like when the engine and vehicle transmission are disengaged.

7. An arrangement for controlling the idle speed of an engine of a motor vehicle having drive wheels, the engine being connected to said drive wheels via a transmission having gears, the arrangement comprising:

an actuator for acting on said engine to influence the speed thereof;

first sensor means for detecting the actual speed of the engine and providing a first signal having an actual value indicative of said actual speed;

second sensor means for detecting the road speed of the motor vehicle;

desired-value forming means connected to said second sensor means for forming a second signal indicative of a desired value of a desired speed for said idle speed dependent upon said road speed;

comparison means for comparing said first and second signals to form a difference signal indicative of the deviation of said desired speed from said actual speed;

a controller receiving said difference signal for forming and supplying an output signal to said actuator to thereby cause said actual speed to approach said desired speed; and, said desired-value forming means further including means for causing said desired value for said idle speed to lead to an adjustment of said engine speed when said motor vehicle is rolling with a gear of said transmission in place to provide a connection between said engine and the drive wheels of said motor vehicle whereby said road speed is adjusted to a minimum without a vibration developing in the torque transmitting connection.

8. The arrangement of claim 7, wherein the minimum value of the road speed is dependent upon engine speed and wherein the arrangement further comprises control means for controlling said minimum value so as not to drop below a road-speed dependent desired value.

9. The arrangement of claim 7, wherein the road speed is limited to a minimum value by controlling the idle engine speed when the engine and transmission of the motor vehicle are engaged.

* * * * *